US009515442B2

(12) United States Patent
Cymerman

(10) Patent No.: US 9,515,442 B2
(45) Date of Patent: Dec. 6, 2016

(54) INTERCHANGEABLE CABLE CONNECTION SYSTEM

(71) Applicant: Scott Cymerman, Conshohocken, PA (US)

(72) Inventor: Scott Cymerman, Conshohocken, PA (US)

(73) Assignee: CONNEXT, LLC, Blue Bell, PA (US)

( * ) Notice: Subject to any disclaimer, the term of this patent is extended or adjusted under 35 U.S.C. 154(b) by 0 days.

(21) Appl. No.: 14/744,823

(22) Filed: Jun. 19, 2015

(65) Prior Publication Data

US 2016/0118758 A1 Apr. 28, 2016

Related U.S. Application Data

(60) Provisional application No. 62/068,997, filed on Oct. 27, 2014.

(51) Int. Cl.
*H01R 13/60* (2006.01)
*H01R 31/06* (2006.01)
(Continued)

(52) U.S. Cl.
CPC ..... *H01R 31/06* (2013.01); *H01R 13/64* (2013.01); *H01R 31/065* (2013.01); *H01R 11/30* (2013.01); *H01R 13/6205* (2013.01)

(58) Field of Classification Search
CPC . H01R 13/6205; H01R 13/64; H01R 13/2421; H01R 31/06; H01R 11/30
(Continued)

(56) References Cited

U.S. PATENT DOCUMENTS 2,306,596 A * 12/1942 Despard ..... H02G 3/0683 174/51
3,363,214 A * 1/1968 Wright ..... H01R 13/6205 439/180
(Continued)

FOREIGN PATENT DOCUMENTS

CN 202444163 U 9/2012
CN 203233020 U 10/2013
(Continued)

OTHER PUBLICATIONS

Title: Laentina BESTEK galaxy S3 samsung tips charger usb adapter power cable connector adapter usb tips power connector apple . . . ; URL: https://www.amazon.com/Laentina-samsung-charger-adapter-connector/dp/B00KQIWCO8?ie=UTF8&*Version*=1&*entries*=0.
(Continued)

*Primary Examiner* — Abdullah Riyami
*Assistant Examiner* — Vladimir Imas
(74) *Attorney, Agent, or Firm* — Massina Pat & TM Law PLLC

(57) ABSTRACT

An electrical connection device for electrically connecting an electronic component of the type having a plurality of electrical connection points. The electrical connection device includes an electrical cable extending between first and second ends with at least one of the ends including an interface plug with a first set of internal contacts in electrical communication with the electrical cable. The device also includes at least one connector adapter including a first end configured for connection to the interface plug and a second end defining an electrical connector. The at least one connector adapter includes a second set of internal contacts configured to conductively engage the first set of internal
(Continued)

contacts such that the electrical connector is in electrical communication with the electrical cable.

20 Claims, 9 Drawing Sheets

(51) Int. Cl.
*H01R 13/64* (2006.01)
*H01R 11/30* (2006.01)
*H01R 13/62* (2006.01)

(58) Field of Classification Search
USPC ..... 439/39, 638, 218
See application file for complete search history.

(56) References Cited

U.S. PATENT DOCUMENTS 3,571,520 A * 3/1971 Clarke, Jr. ..... H04M 3/60 439/180
3,808,577 A * 4/1974 Mathauser ..... H01R 13/6205 439/180
5,401,175 A * 3/1995 Guimond ..... H01R 13/6205 439/38
5,873,737 A * 2/1999 Hashizawa ..... B60L 11/1818 439/310
5,992,290 A * 11/1999 Quebedeaux ..... F41G 7/007 89/1.51
6,250,931 B1 * 6/2001 Mendelson ..... H01R 13/6205 439/38
6,267,602 B1 * 7/2001 Mendelson ..... H01R 13/7137 439/38
6,623,276 B2 * 9/2003 Dalmau Ferrerfabrega .... H01R 13/6205 335/205
6,908,324 B1 6/2005 Morley et al.
6,976,882 B2 * 12/2005 Kernan ..... H01H 37/02 219/432
7,066,767 B2 6/2006 Liao
7,311,526 B2 * 12/2007 Rohrbach ..... H01R 13/6205 439/218
7,445,452 B1 * 11/2008 Wu ..... H01R 13/6205 439/39
7,473,141 B2 1/2009 Liao
7,517,222 B2 * 4/2009 Rohrbach ..... H01R 13/6205 439/39
7,520,782 B1 * 4/2009 Huang ..... H01R 31/06 439/516
7,559,795 B2 7/2009 Byrne
7,566,224 B2 * 7/2009 Wu ..... H01R 13/6205 439/39
7,607,920 B1 * 10/2009 Chen ..... H01R 31/06 439/39
7,625,212 B2 * 12/2009 Du ..... H01R 13/6205 439/39
7,641,477 B2 * 1/2010 DiFonzo ..... H01R 13/641 439/39
7,658,613 B1 * 2/2010 Griffin ..... H01R 13/6205 439/39
7,726,974 B2 * 6/2010 Shah ..... G05B 15/02 439/40
7,874,844 B1 * 1/2011 Fitts, Jr. ..... H01R 13/6205 439/218
8,172,580 B1 * 5/2012 Chen ..... H01R 13/6205 320/111
8,241,053 B2 * 8/2012 Slippy ..... H01R 13/5808 439/353
8,362,656 B2 * 1/2013 Ho ..... H01R 13/7037 307/140
8,517,772 B2 8/2013 Wu
8,550,856 B2 10/2013 Lin
8,634,304 B2 * 1/2014 Motter ..... H04L 12/2697 174/113 R
8,696,366 B2 * 4/2014 Chen ..... H01R 13/6205 439/39
8,790,120 B2 * 7/2014 Wang ..... H01R 13/6205 439/39
8,894,419 B1 * 11/2014 Buelow ..... H01R 13/6205 439/218
9,065,205 B2 * 6/2015 Gao ..... H01R 13/508
9,080,734 B2 * 7/2015 Andersen ..... F21L 4/00
9,083,099 B2 * 7/2015 Yi ..... H01R 11/30
9,083,110 B2 * 7/2015 McClelland ..... H01R 13/6205
9,088,097 B2 * 7/2015 Kim ..... H01R 13/6205
2007/0197052 A1 8/2007 Liao
2011/0095767 A1 * 4/2011 Motter ..... H04L 12/2697 324/539
2014/0106590 A1 4/2014 Wu et al.
2014/0106623 A1 4/2014 Wu et al.
2014/0170909 A1 6/2014 Liao
2014/0273581 A1 9/2014 Mcsweyn
2014/0273644 A1 9/2014 Mcsweyn et al.

FOREIGN PATENT DOCUMENTS

CN 203277909 U 11/2013
JP 3113283 U 9/2005

OTHER PUBLICATIONS

Title: Philips SWR1249/17 Retractable USB 2.0 Adapter Kit; URL: http://www.amazon.com/Philips-SWR1249-17-Retractable-Adapter/dp/B002R5AMD6/ref=sr_1_47?ie=UTF8 &qid=1415111802&sr=8-47&keywords=usb+multiple+adapter.
Title: [Micro USB + Lightning] Inateck? 2 in 1 Micro USB Cable + Apple Lightning Adapter Cable 1.2m/ 4ft; Fits iPhone 6/5/5s/5c/iPad 4/iPad air/iPad mini mini2/iPad 4th gen/Amazon Kindle/Samsung Galaxy S3 S4 and Tablets/HTC Phone/Nexus; URL: https://www.amazon.com/Lightning-Inateck-Adapter-Samsung-Tablets/dp/B00KV8J6M4?ie=UTF8?ref_=cm_cr_arp_d_bdcrb_top.
Title: ReTrak Retractable USB 2.0 Cable with Multi-Tip Adapter (ETCABLESTAR); URL: URL: http://www.amazon.com/ReTrak-Retractable-Multi-Tip-Adapter-ETCABLESTAR/dp/B000HWZYCU.

* cited by examiner

| Side A Pin # | Designation | Wire Size (awg) | Pairing | Side B Pin # |
|---|---|---|---|---|
| 1 | GND/DR | 20 | P1 | 1 |
| 2 | DATA 4 (-) | 28 | TS4 | 4 |
| 3 | DATA 1 (-) | 28 | TS1 | 5 |
| 4 | DATA 3 (-) | 28 | TS3 | 2 |
| 5 | DATA 2 (-) | 28 | TS2 | 3 |
| 6 | PWR | 20 | P1 | 6 |
| 18 | PWR | 20 | P2 | 18 |
| 19 | DATA 3 (+) | 28 | TS4 | 21 |
| 20 | DATA 2 (+) | 28 | TS2 | 22 |
| 21 | DATA 4 (+) | 28 | TS3 | 19 |
| 22 | DATA 1 (+) | 28 | TS1 | 20 |
| 23 | GND | 20 | P2 | 23 |

Data Wire (28 AWG)
Power Wire (20 AWG)
Drain Wire (32 AWG)
Al/Mylar EMI Shield

USB 2.0 A (Host)

| Cable End Pin # | Designation | USB End Pin # |
|---|---|---|
| 1 | | |
| 2 | | |
| 3 | | |
| 4 | | |
| 5 | DATA 1 (+) | 3 |
| 6 | | |
| 18 | PWR | 1 |
| 19 | | |
| 20 | | |
| 21 | | |
| 22 | DATA 1 (-) | 2 |
| 23 | GND | 4 |

USB 2.0 Micro B (Client)

| Cable End Pin # | Designation | USB End Pin # |
|---|---|---|
| 1 | | |
| 2 | | |
| 3 | DATA 1 (+) | 3 |
| 4 | | |
| 5 | | |
| 6 | | |
| 18 | PWR | 1 |
| 19 | | |
| 20 | DATA 1 (-) | 2 |
| 21 | | |
| 22 | | |
| 23 | GND | 5 |
| *Micro USB Pin #4 Not Used | | |

INTERCHANGEABLE CABLE CONNECTION SYSTEM

This application claims the benefit of U.S. Provisional Application No. 62/068,997, filed on Oct. 27, 2014, the contents of which are incorporated herein by reference.

FIELD OF THE INVENTION

The present invention relates to an interchangeable cable connection system.

BACKGROUND OF THE INVENTION

The capability of electronic devices continues to grow in power and ability each year; however, despite these advances, one component that is continuously overlooked is the electrical connection cable essential to the operation of these devices. The electrical connection cable transfers data and provides power, but possess limitations.

The first limitation to the currently available connection cables is their lack of versatility. Presently, device to device connectivity is limited by the fixed end cables supplied with these devices. For example, a cable supplied with a cellular phone will have two fixed standard plug types at each end, for example, a Micro USB 2.0 B at one end and a USB 2.0 A at the other end. Although standard connection adapters exist, their connectivity is limited by the physical number of wires in the cable. Using the same example above, an adapter that converts the Micro USB 2.0 B plug to a USB 3.1 Type C plug will physically fit the USB 3.1 Type C device, but will be unable to utilize its full capabilities due to the already existent cable composition of only 4 wires when a USB 3.1 Type C device needs 15 connection pins to be fully functional.

An additional limitation to the currently available electrical connection cables and converters is their lack of durability. For example, if the converter is connected to a cable and either end is suddenly stressed, there is a high probability that the cable and/or connector will be damaged. Even normal everyday use wears on the mechanical connection points. Over time the repeated mate/demate cycles will inevitably degrade the mechanical connection configuration, rendering the entire cable useless.

Due to the design, inflexibility and quality limitations described above in part, consumers will inevitably purchase a multitude of cables. Collecting large numbers of cables not only has a negative effect on the consumer from a financial perspective, but will lead to confusion, mismanagement of cables, and frustration.

SUMMARY OF THE INVENTION

In at least one embodiment, the present invention provides an interchangeable cable connection system which allows for greater versatility and increased efficiency amongst a reduced quantity of electrical cables and adapters. The system consists of an insulated electrical cable with a set number of conductors, ultimately terminating at both ends within unique interface plugs. In almost every case, the number of wires within a specific cable will be no less than the largest number of available connection pins on any one of its compatible adapters, thereby allowing every cable compatible adapter (and in turn device) its full signaling potential. These terminals mate with adapters that subsequently mate with an ever expanding collection of electronic or electrical devices. Each adapter is designed to mate with the cable interface plug on one end, provide an electrical connection through the adapter, and connect to the device on the other end employing various industry standard and commercially available connection methods (i.e. USB, HDMI, 120V AC, etc.). A fully assembled system allows for virtually any combination of device(s) to device(s) electrical connection.

The system has many different configurations depending on desired use. The cable component can be manufactured in a variety of lengths, using various quantities and sizes of electrical conductors, and multiple unique interface plugs. The adapters can be manufactured with limitless specific device connection types, connection length extenders, electrical conductor splitters for simultaneous connection to additional devices, added device orientation flexibility, and electrical signal adjustment components (transformers, inverters, etc.)

The system has added benefits to connectivity management within the specific design. In at least one embodiment, the adapters mate with the cable plugs using a magnetic connection, which greatly reduces mechanical joint fatigue failure. The electrical contact pins for the cable to adapter conjunction are fully enclosed within the structure of the components, which reduces the probability of external damage. Each cable plug can be geometrically keyed to fit only compatible adapters depending on multiple cable characteristics (i.e. cable end, cable length, cable electrical conductor count, etc.), greatly reducing the risk of either device damage or insufficient electrical connection. Each cable is wired such that only compatible adapters are electrically connected with each other, adding to device damage risk reduction. This can also be accomplished using embedded logic circuits to smartly determine adapter to adapter compatibility.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
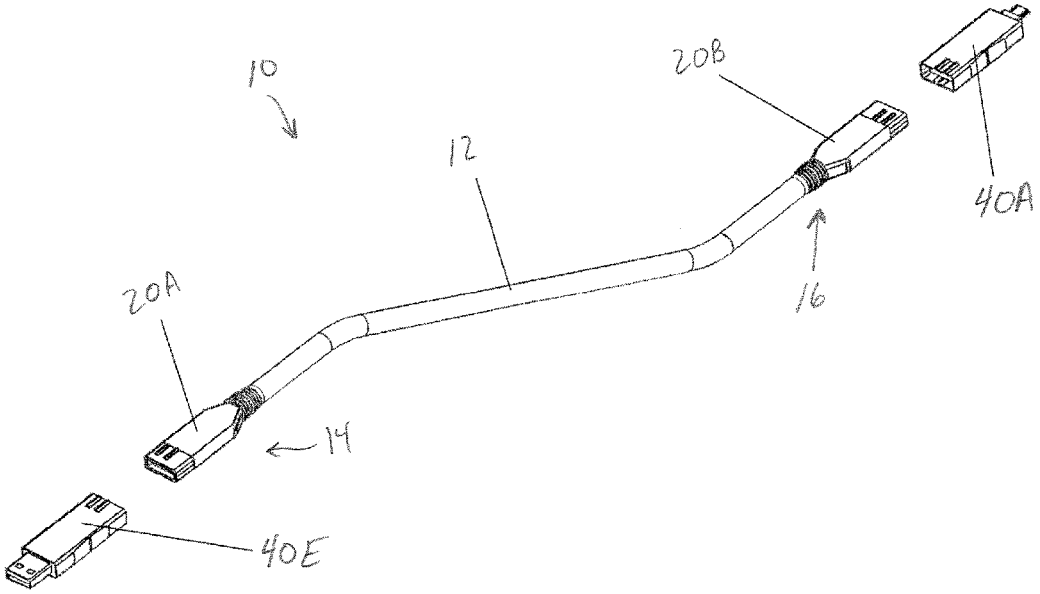
FIG. 1 is an isometric view of an exemplary cable connection device in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIG. 1, an exemplary interchangeable cable connection system 10 is illustrated and generally comprises a cable portion 12 extending between first and second ends 14, 16. The cable portion 12 includes multiple shielded and jacketed conductors, wires or the like, establishing electrical communication between the ends 14, 16. Each end 14, 16 includes an interface plug 20A, 20B configured for connection to a connector adapter 40, as will be described in more detail below. This assembly provides an electrical path between compatible devices connected to the adapters 40 at each end allowing for power and/or data transmission. The device connection end of each adapter 40 is one of many industry standard and commercially available connection methods (i.e. USB, HDMI, 120V AC, etc.). Illustrated in FIG. 1, the adapter 40E in this representation is that of a USB 2.0 A plug and the adapter 40A is that of a Micro USB 2.0 B plug. The representations are not limiting of the assortment of producible adapters with various device connection ends.

Figure 2:
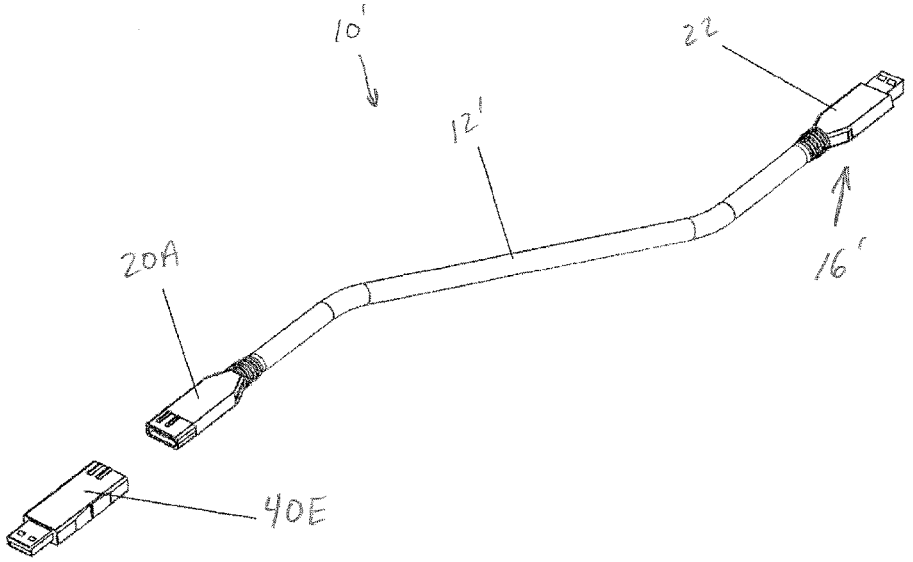
FIG. 2 is an isometric view of an exemplary cable connection device in accordance with another embodiment of the invention.

FIG. 2 illustrates an interchangeable cable connection system 10' which is substantially the same as the first embodiment except that one end 16' of the cable 12' includes a fixed connector 22. For example, FIG. 2 shows the fixed connector 22 as a USB 2.0 A connector, but it can be any number of fixed connectors. The cable portion 12' contains shielded and jacketed wires. In all other aspects, the connection systems 10, 10' are the same and will be described below with reference to the connection system 10.

Figure 3:
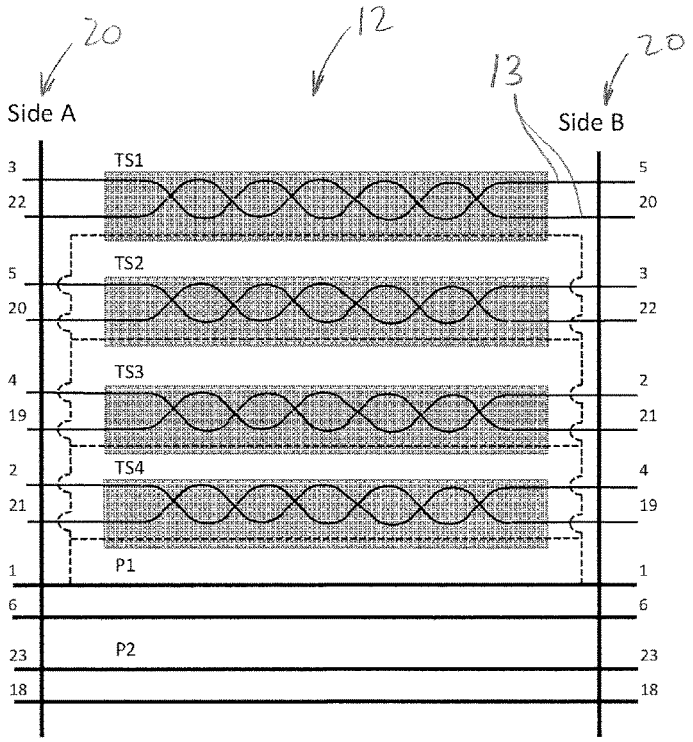
FIG. 3 is a representative cable wiring diagram.

With reference to FIG. 3, the cable portion 12 is an insulated electrical cable with various conductors terminating in interface plugs 20A, 20B as described above. The outer cable jacket is made from pliable materials capable of withstanding significant flexing and bending while still providing an electrical insulating barrier for the inner components. The next cable layers comprise of any number of metallic braided shielding, and/or metallic foil shielding, and/or metallic electrical drain wires. Under these layers are any number of various gauged jacketed metallic wire, which can be solid, stranded, flux core, fiber optic, or any other electrically transmissive material. These wires 13 are not limited to but may be grouped in twisted pairs shielded by metallic foil, unshielded twisted pairs, single wire shielded by metallic foil, or unshielded single wire. In almost every case, the number of wires within a specific cable are no less than the largest number of available connection pins on any one of its compatible adapters, thereby allowing every cable compatible adapter (and in turn device) its full signaling potential. In exemplary embodiment, the number of wires is at least 32 with the interface plug 20 having an equal number of pins. Any number of drain wires may be used to carry unwanted electrical charge buildup on any cable component out of the cable through ground wire pins. Cable filler of various materials may be used to provide support and stability to the cable. The wiring design shown is consistent with a crossover cable wiring methodology. However, the invention is not limited by this methodology and can be wired as a straight through cable, or any other combination of pin to pin wiring methods.

Figure 4:
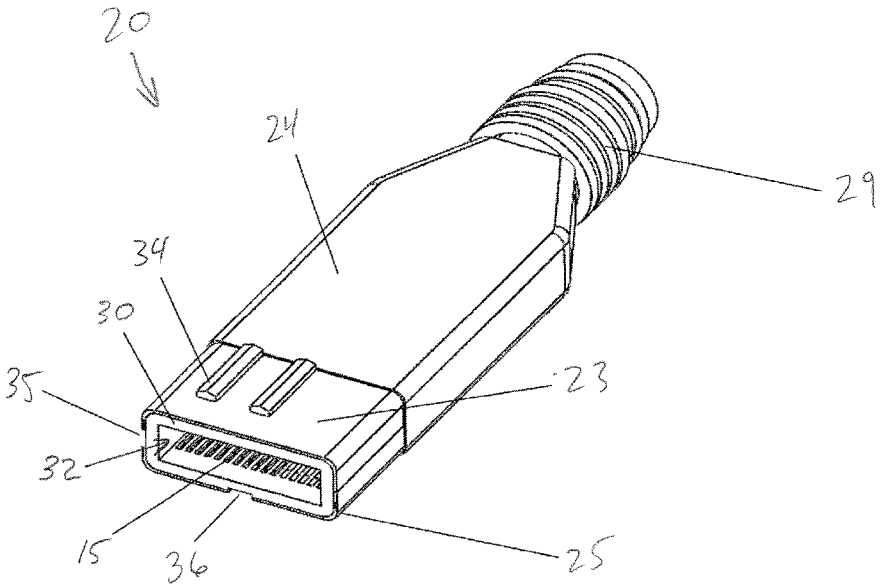
FIG. 4 is an isometric view of a representative interface plug.
Figure 5:
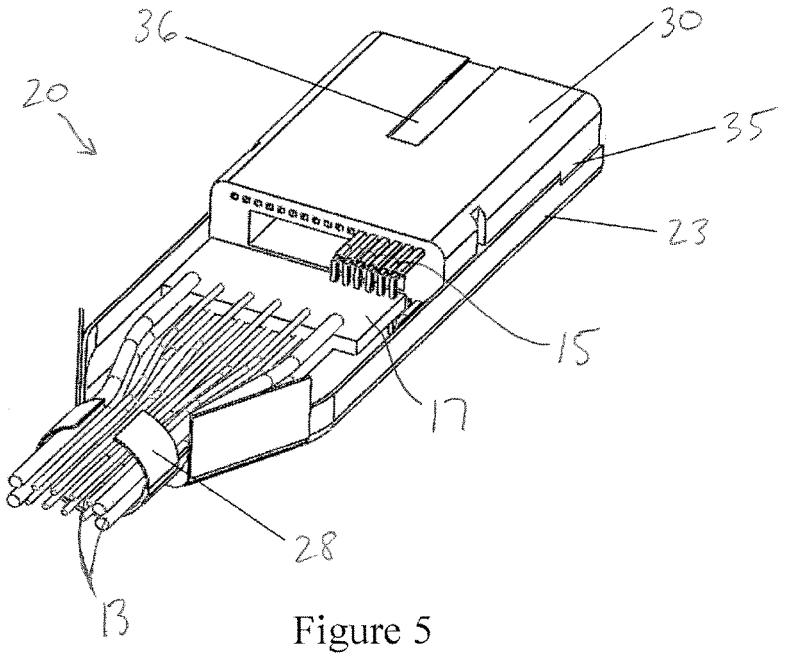
FIG. 5 is an isometric view of the representative interface plug with a portion of housing removed to show the internal components. Note that certain components of the interface plug are removed for clarity.
Figure 6:
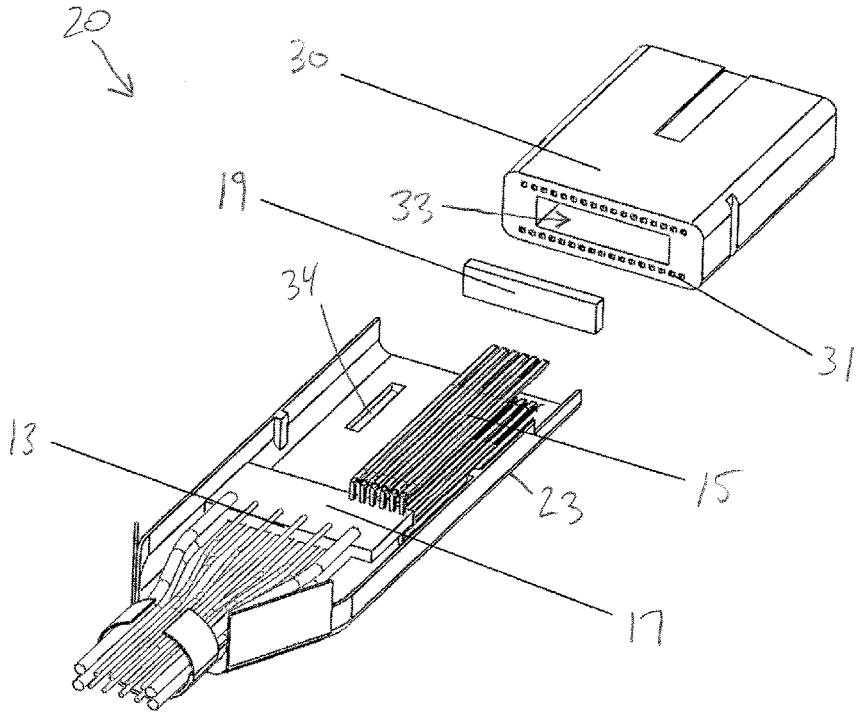
FIG. 6 is an exploded view of the representative interface plug of FIG. 5.

With reference to FIGS. 4-6, the interface plugs 20 including a conductive housing 23, 25 at least partially enclosed within an insulative jacket 24 of, for example, moldable material (i.e. rubber, plastic, etc.). The insulative jacket 24 protects the plug as well as provides a level of compression such that the underlying components maintain position. The housing components 23, 25 are constructed from an electrically conductive material and both provide support and enclosure for the underlying components, as well as provide a conductive path to bleed accumulated static charge from the cable. The outer cable shields (not shown) are attached to the curved end 28 of the housing components 23, 25 for the purpose of charge bleed. The outside layers of the housing components 23, 25 mate with the inside layers of the adapter mating ring 27, as described hereinafter, in order to provide an electrical pathway through the interface plug.

The interface plug includes a pliable material (rubber, plastic, etc) kink protector 29 in order to ensure the connection point between the cable jacketing and the interface plug 20 remains undamaged by excessively small cable bend radii. The conductive wires 13 enter the interface plug 20 through the kink protector 29. The wires 13 are attached (solder, etc.) to one side of a printed wiring board (PWB) 17 that then routes the electrical signal to the attached contact pins 15 on the other side of the PWB 17. The contact pins 15 are made from suitable electrically conductive materials. The wires to contact pin connection is not limited to a PWB. Direct wire to pin connection through solder joints, crimps, etc. may be employed by the invention. The contact pins 15 are held in place by insulative interface plug pin support structure 30, which may be, for example, be a molded plastic component. The pin support structure 30 is received and retained in the open end of the housing components 23, 25. The pin support structure has a front passageway 32 and a rear passageway 33 which are preferably separated by an internal wall. Each pin 15 extends through a respective through passage 31 in the rear of the pin support structure 30 such that each pin 15 is insulated relative to the remaining pins and then is exposed within the front passageway 32 (see FIG. 4). The pins 15 are thereby protected within the pin support structure 30 and the housing components 23, 25. The pin support structure provides the necessary geometric configuration to ensure a successful adapter mate is achieved both by supporting the adapter interface geometry and properly aligning contact pins from the interface plug and adapter.

The pin support structure 30 in the configuration shown also houses the magnetic bar 19 used to ensure a mated adapter 40 remains connected. The magnetic bar 19 is retained within the rear passageway 33 and is configured to magnetically engage with a corresponding member of one of the adapters 40 as will be described in more detail hereinafter. The interface plug to adapter mating mechanism is not limited to a magnetic connection. Mechanical, press fit, or any other connection method may be employed by the invention. The separation force needed to separate the interface plug from the adapter is designed to always be less than the separation force needed to separate the standard connection plug of the adapter from the connected device. This design feature reduces the likelihood of device damage when excessive tension is applied to the connected cable assembly. All components within the housing components 23, 25 are secured by a wide variety of bonding agents.

The housing components 23, 25 may also include unique keying features in order to prevent incompatible adapters, and therefore devices, from interfacing with each other. Keying features incorporated in the device as described below are specific to the configuration shown, but do not limit the design concept. Projections 34 on the top surface of the housing component 23 are intended to ensure standard maximum transmit cable lengths are adhered to, thereby mitigating unwanted signal dropouts. As a result, adapters 40 in which the maximum recommended cable length (as provided by the specific connection standard; USB, Firewire, HDMI, etc.) is exceeded by the current cable cannot fully mate and create a usable cable assembly. Grooves 36 on the surface of the other housing component 25 control cable end compatibility. In this specific representation, a cable in which cable end mating control is required have an interface plug on one end, denoted side A, that includes one keying groove 36, and an interface plug on the other end, denoted side B, that includes two keying grooves (not shown). Depending on the connection standard, adapters can be keyed to be compatible with Side A, Side B, or both. The wiring design of this invention (cable and adapters) allows for the use of the same adapter on both sides of the cable (for certain adapters) by using crossover cable wiring methodology described above. Certain standard connections are the same plug on both ends of the cable (i.e. Firewire, Apple Thunderbolt). An adapter 40 can be employed on one end of the cable 12 to convert the cable wiring from crossover to straight through allowing for the use of the same adapter in which its wiring design employs a straight through methodology (i.e. HDMI, VGA, etc.). Grooves 35 on the sides of the interface plug control cable configuration compatibility. This can include, but is not limited, to configurations that include different numbers of connection pins/transmit wires within the cable and interface plug geometry. Compatible adapters 40 have the appropriate side grooves to mate completely with the respective interface plug.

The Side A to Side B pin connections are another compatibility design feature to ensure incompatible devices do not interface with each other. For example, if two standard connections (i.e. Firewire and USB) use different power levels, the Side A to Side B pin connections are designed such that the power connection on Side A used by one standard connection (i.e. Firewire) does not align with the power connection on Side B used by the other standard connection (i.e. USB). In this example, this design feature mitigates the possibility of overpowering a USB device with a Firewire source if the USB and Firewire adapters are inadvertently used to connect these incompatible devices. See FIG. 2 for a visual example of this design feature. This electronic compatibility verification can also be accomplished using an embedded logic circuit within the interface plugs and adapters. The logic circuits only allow compatible adapters (and therefore devices) to interface with each other. If the prescribed logic check fails, the signal transmission circuits remain open, resulting in no communication between devices. This prevents possible damage to the connected devices.

Figure 7:
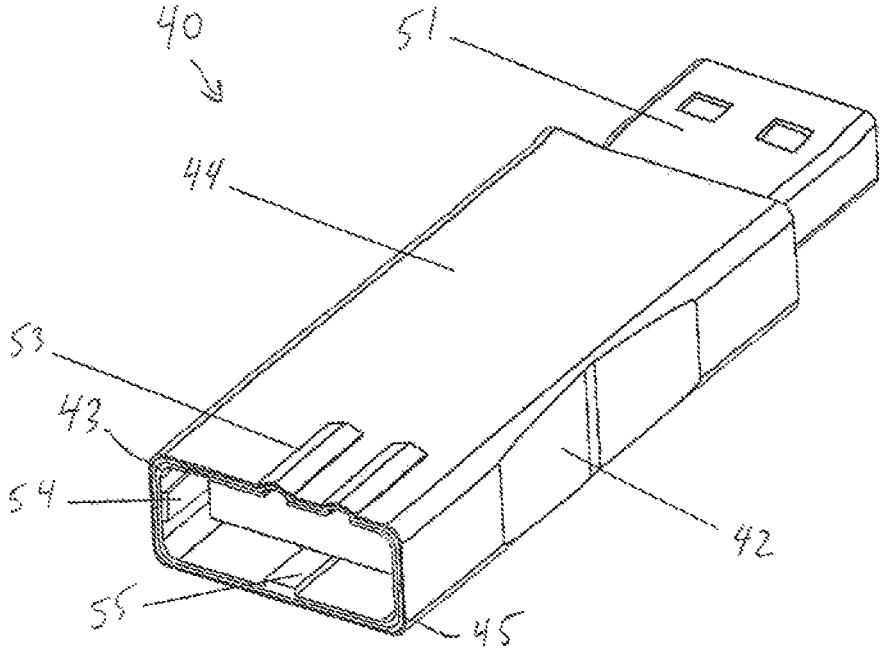
FIG. 7 is an isometric view of a representative adapter.
Figure 8:
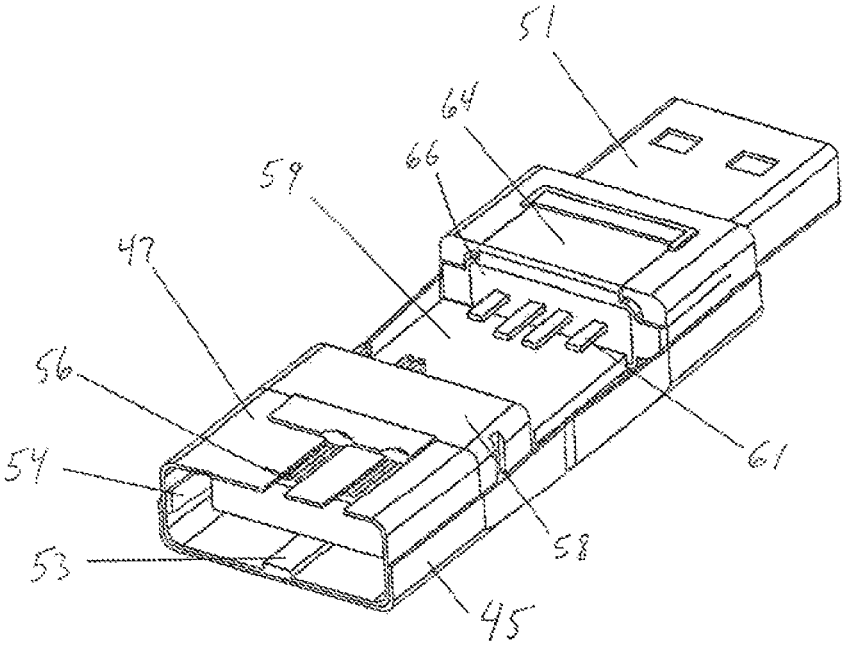
FIG. 8 is an isometric view of the representative adapter with a portion of housing removed to show the internal components. Note that certain components of the adapter are removed for clarity.
Figure 9:
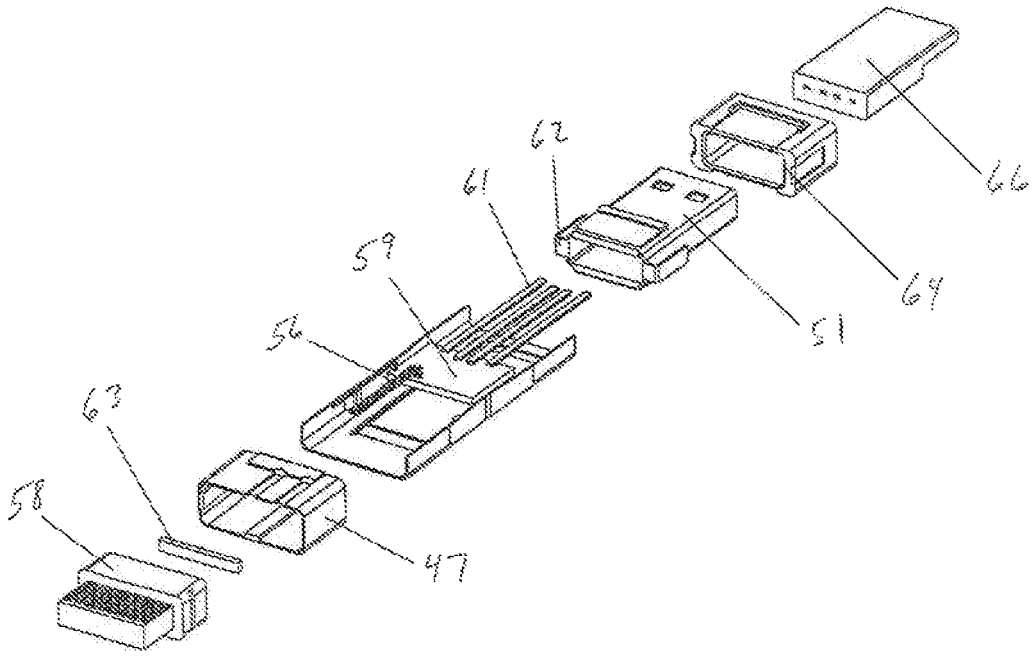
FIG. 9 is an exploded view of the representative adapter of FIG. 8.

With reference to FIG. 7-9, the adapters 40 including a conductive housing 43, 45 at least partially enclosed within an insulative jacket 44. The jacket 44 is preferably manufactured of moldable material (i.e. rubber, plastic, etc.) and both protects the adapter as well as provide a level of compression such that the underlying components maintain position. The adapter handling grip 42 ensures the user maintains a secure grip on the adapter 40 when assembling a cable assembly and/or when connecting to a device. The housing components 43, 45 are constructed from an electrically conductive material and both provide support and enclosure for the underlying components, as well as provide a conductive path to bleed accumulated static charge from the cable. The housing components 43, 45 are in electrical contact with an internal adapter mating ring 47. The outside layers of the interface plug housing components 23, 25 mate with the inside layers of the electrically conductive adapter mating ring 47 in order to provide an electrical pathway from the interface plug to the adapter. The adapter mating ring 47 is in contact with the adapter housing components 43, 45 which are in turn in contact with the standard connection plug 51 as will be described hereinafter. When the standard connection plugs 51 of a fully assembled connection device 10 are mated with their respective devices, a completed static charge bleed path is created in order to mitigate any ill effects of this charge build up. The adapter mating ring 47 and/or the housing components 43, 45 also include the corresponding unique keying features 53, 54, 55 presented in the interface plug section above in order to prevent incompatible adapters, and therefore devices, from interfacing with each other.

The interface plug contact pins 15 are aligned to appropriately contact the adapter contact pins 56 through the geometric compatibility between the interface plug pin support structure 30 and a combination of the adapter pin support structure 58, which holds the pins 56, and the adapter mating ring 47. The adapter pin support structure 58 in the configuration shown houses the magnetic bar 63, see FIG. 9, used to ensure the mated interface plug remains connected. As stated above, the interface plug to adapter mating mechanism is not limited to a magnetic connection. Mechanical, press fit or any other connection method may be employed by the invention.

The adapter contact pins 56 are attached (solder, etc.) to one side of a PWB 59 that then routes the electrical signal to the attached standard connection contact pins 61 on the other side of the PWB. The adapter contact pin to standard connector contact pin connection is not limited to a PWB. Direct pin to pin connection through solder joints, crimps, etc. may be employed by the invention. The standard connection contact pins 61 are held in place by a block 66 which is housed within the standard connection plug 51 and retained by an end cap 64. The block 66, plug 51 and cap 64 are specific to both interface and fit of the specific adapter 40, as well as mate with the desired device input port. A USB 2.0 A is shown as an example. In this embodiment, the plug 51 includes flaps 62 which are standard with the type of connection plug 51. Other standard connection plugs are designed in a similar manner.

Figure 10:
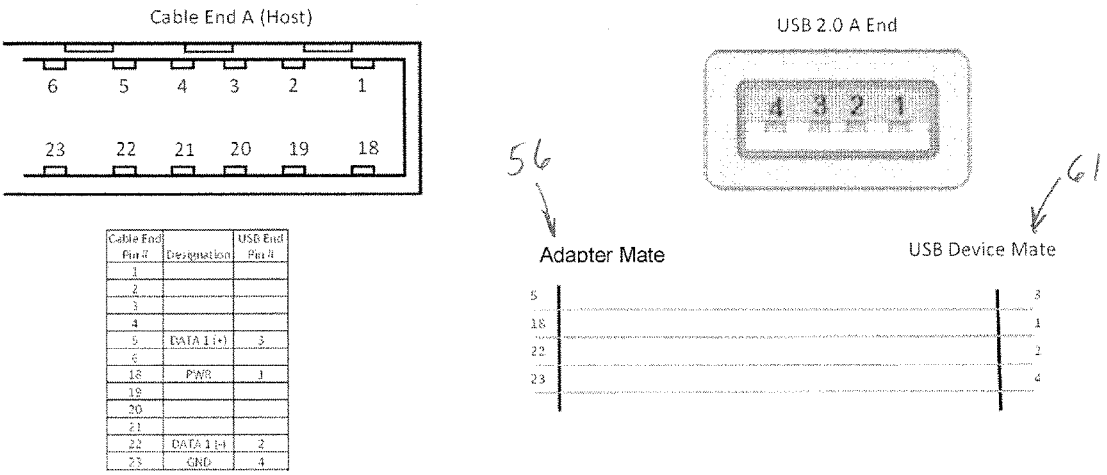
FIG. 10 is a representative USB 2.0 A adapter wiring diagram.
Figure 11:
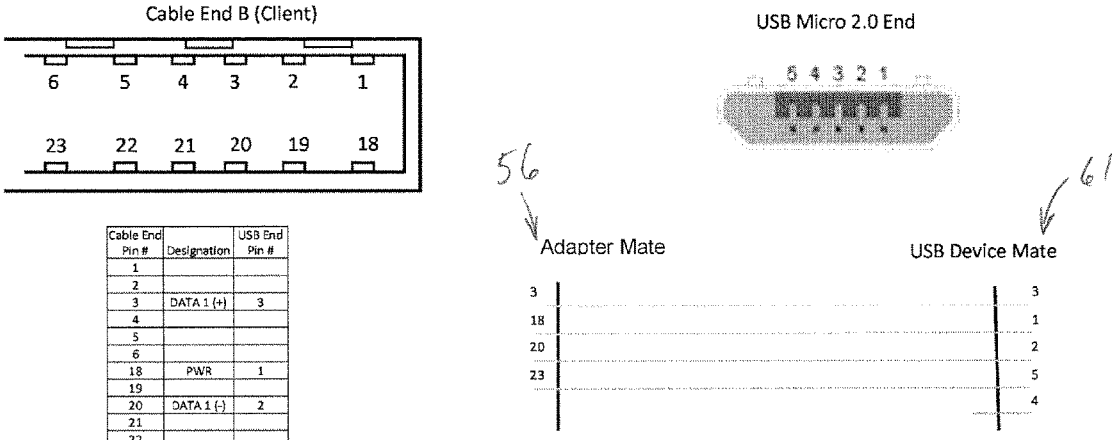
FIG. 11 is a representative Micro USB 2.0 B adapter wiring diagram.

The pin to pin connection design is determined by the transmission lines required by the standard connector plug type. Full assembly pin to pin connection designs ensure the proper electrical signal sent by the host device is received by the proper client device pin. As shown in FIGS. 3, 10 and 11, it can be seen that the design of the adapters ensures the correct signal is sent and received. These wiring diagrams are for demonstration purposes and may be modified as needed.

Figure 12:
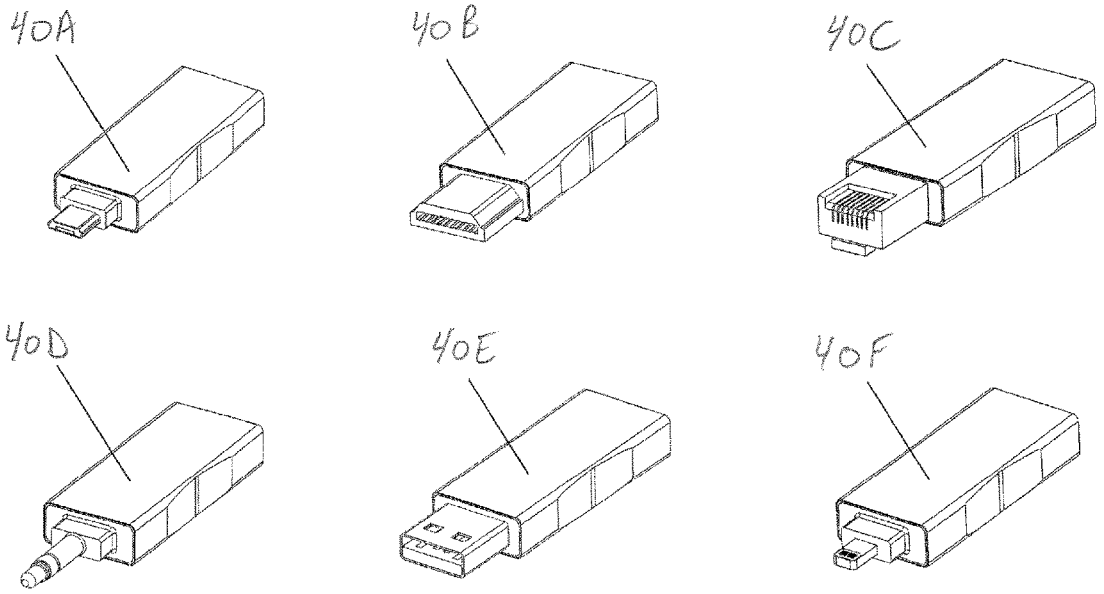
FIG. 12 illustrates various versions of the adapter with different standard connections types.
Figure 13:
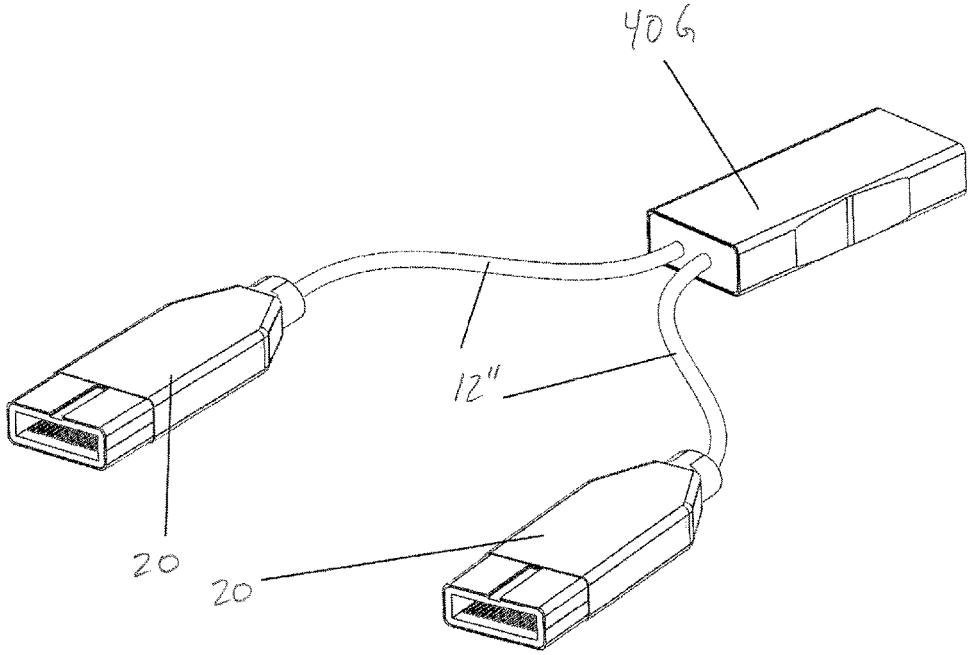
FIG. 13 is an isometric view of a representative splitter adapter.

With reference to FIGS. 12-13, although the above details the design of a specific type of cable assembly, it does not limit the expandability of the design concept. The device 10 may include multiple standard connection types; for example, a Micro USB 2.0 B adapter 40A, a HDMI adapter 40B, an RJ45 Network adapter 40C, a 3.5 mm Audio adapter 40D, a USB 2.0 A adapter 40E, an Apple Lightning adapter 40F, etc., cable length extenders (not shown), and a splitter adapter 40G that splits the single cable assembly, allowing for the connection of multiple devices to the single cable. The cable length extender provides the ability to join two separate cables and create one longer cable. The splitter either splits the signal or power stream from individual wires, or reroutes the collection of wires towards different devices, allowing for dual charging and/or dual signaling. The splitter adapter 40G consists of two cables 12" protruding from the connector adapter housing, each terminating in a unique interface plug 20. Connector adapters 40 with the desired plug are attached to these terminal ends.

Figure 14:
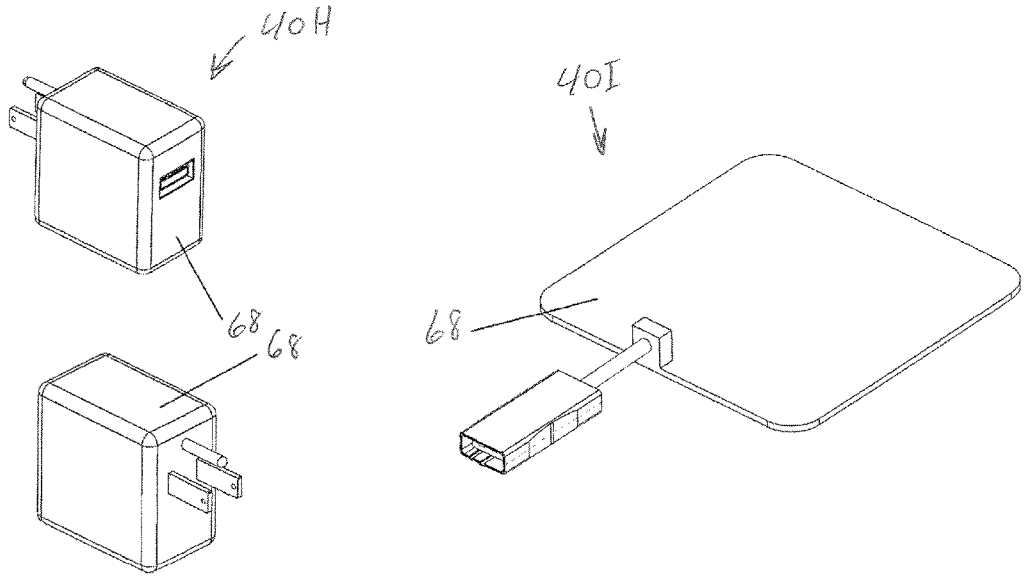
FIG. 14 illustrates various versions of representative power transmission adapter assemblies.

With reference to FIG. 14, the adapters 40 may also be utilized for power transmission. The adapters 40I, 40H for this application are designed similar to that which is described above but also include power transformers and/or inverters 68 in order to step up or down voltage, switch from AC to DC (or DC to AC), or simply transmit input power to the device connected on the other end of the invention assembly. As a result of AC power transmission, a wireless charging adapter 40I can be utilized as a component of the invention assembly.

Figure 15:
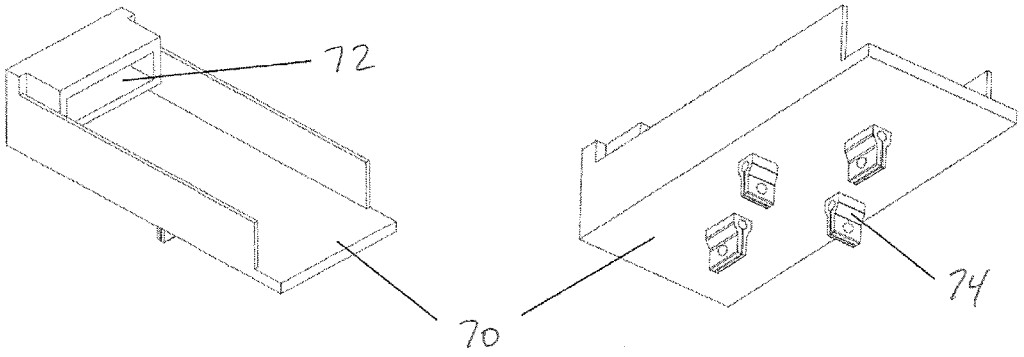
FIG. 15 is an isometric view of a representative adapter holder.

With reference to FIG. 15, presented is a convenient adapter holder 70 made from a multitude of different materials (plastic, rubber, metal, etc.) depending on the user preferences. The adapter holder 70 secures the adapter 40 with a geometrically compatible plug 72 which fits inside of the adapter. The securing method can be magnetic (similar to described above), mechanical, press fit, etc. The holder also includes clips 74 that fit around the cable 12 and can secure it to the cable assembly. The two orthogonal sets of securing features 74 allow for two connection orientations.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. An electrical connection device for electrically connecting an electronic component of the type having a plurality of electrical connection points, said electrical connection device comprising:

an electrical cable extending between first and second ends, at least one of the ends including an interface plug having a first housing with a first set of internal contacts in electrical communication with the electrical cable, the first housing extending laterally beyond the first set of internal contacts such that the first set of internal contacts are internally within the first housing; and at least one connector adapter including a first end configured for connection to the interface plug and a second end defining an electrical connector, the at least one connector adapter including a second housing extending laterally beyond a second set of internal contacts such that the second set of internal contacts are internally within the second housing and configured to conductively engage the first set of internal contacts such that the electrical connector is in electrical communication with the electrical cable.

2. The electrical connection device according to claim 1 wherein complementary securing members are provided in the interface plug and the connector adapter.

3. The electrical connection device according to claim 2 wherein the complementary securing members include a magnet positioned within each of the interface plug and the connector adapter.

4. The electrical connection device according to claim 1 wherein each interface plug is connected to a respective end of the electrical cable via an elastic kink protector.

5. The electrical connection device according to claim 1 wherein the electrical cable includes a plurality of conductors, with each conductor in electrical communication with a respective internal contact of the interface plug.

6. The electrical connection device according to claim 1 wherein the number of conductors and associated internal contacts is at least 32.

7. The electrical connection device according to claim 1 wherein the electrical cable includes a plurality of conductors extending between the first and second ends and the conductors are wired with a crossover cable wiring methodology.

8. The electrical connection device according to claim 1 wherein the electrical cable includes a plurality of conductors extending between the first and second ends and the conductors are wired with a straight through cable wiring methodology.

9. The electrical connection device according to claim 1 wherein the electrical connector is selected from the following connector types: a Micro USB 2.0 B adapter, a HDMI adapter, an RJ45 Network adapter, a 3.5 mm Audio adapter, a USB 2.0 A adapter, an Apple Lightning adapter, a cable length extender adapter, and a power adapter.

10. The electrical connection device according to claim 1 wherein the electrical connector is a splitter adapter includes a pair of cables extending from a connector adapter housing, each cable terminating in a unique interface plug.

11. The electrical connection device according to claim 1 wherein each interface plug includes a first pin support structure within the first housing and the internal contacts include first pins which extend within a passageway of the first pin support structure such that the first pins are internal to the first housing and the first pin support structure.

12. The electrical connection device according to claim 11 wherein each connector adapter includes a second pin support structure within the second housing and the internal contacts include second pins which extend along an outer surface of the second pin support structure such that the second pins are internal to the second housing.

13. The electrical connection device according to claim 12 wherein upon connection, the second pin support structure is received within the passageway of the first pin support structure and the first and second pins contact one another.

14. The electrical connection device according to claim 1 wherein the first and second housings are made from electrically conductive materials and are in electrical connection to one another.

15. The electrical connection device according to claim 1 wherein each interface plug includes a first housing and each connector adapter includes a second housing and wherein the first and second housings include keying features which dictate which connector adapters may be connected to a respective interface plug.

16. The electrical connection device according to claim 1 wherein each of the first and second ends includes an interface plug.

17. The electrical connection device according to claim 1 wherein a second of the ends includes a fixed connector.

18. The electrical connection device according to claim 1 further comprising an adapter holder including a platform with a plug configured to engage a housing of a respective connector adapter.

19. The electrical connection device according to claim 18 wherein at least one cable clip is provided on an opposite side of the platform.

20. The electrical connection device according to claim 16 wherein the interface plugs on the first and second ends have the same internal contact mounting configuration.

* * * * *